United States Patent [19]

Crawley et al.

[11] Patent Number: 4,972,041

[45] Date of Patent: Nov. 20, 1990

[54] RIBBON CABLES HAVING WRAPPED DRAIN WIRES

[75] Inventors: Jerald M. Crawley; John C. Hostler, both of Flagstaff, Ariz.

[73] Assignee: W. L. Gore & Associates, Inc., Newark, Del.

[21] Appl. No.: 381,613

[22] Filed: Jul. 18, 1989

[51] Int. Cl.[5] ..... H01B 7/34; H01B 7/08

[52] U.S. Cl. ..... 174/36; 174/115; 174/117 F

[58] Field of Search ..... 174/36, 115, 117 F

[56] References Cited

U.S. PATENT DOCUMENTS

| | | | |
|---|---|---|---|
| Re. 31,197 | 4/1983 | Cocco | 174/117 F X |
| 4,287,385 | 9/1981 | Dombrowsky | 174/117 F X |
| 4,443,657 | 4/1984 | Hill et al. | 174/117 F X |
| 4,481,379 | 11/1984 | Bolick, Jr. et al. | 174/117 F X |
| 4,490,574 | 12/1984 | Tomita et al. | 174/117 F |
| 4,492,815 | 1/1985 | Maros | 174/117 F X |
| 4,564,723 | 1/1986 | Lang | 174/117 F X |

FOREIGN PATENT DOCUMENTS

| | | | |
|---|---|---|---|
| 1048619 | 1/1959 | Fed. Rep. of Germany | 174/115 |
| 2644252 | 3/1978 | Fed. Rep. of Germany | 174/117 F |

*Primary Examiner*—Morris H. Nimmo

[57] ABSTRACT

A multi-conductor flat ribbon cable for transmission of data signals having firmly-held accurately spaced apart drain wires wrapped with spaced-apart coils of polymer fibers.

9 Claims, 2 Drawing Sheets

RIBBON CABLES HAVING WRAPPED DRAIN WIRES

FIELD OF THE INVENTION

The present invention relates to flat multi-conductor ribbon cables for transmission of data signals which are compatible with insulation displacement connectors (IDC's) and which provide a drain wire to facilitate termination of the cable shield to ground.

BACKGROUND OF THE INVENTION

Multi-conductor ribbon cables of this type are generally made up of insulated solid or stranded signal conductors separated and spaced apart at fixed distances by webs of the same or different insulation as that covering the conductor. Solid or stranded metal drain wires are included, usually at the edge of the cable to provide grounding of the cable. Metal shielding, such as perforated copper foil or braided nickel-plated copper in the plane of the cable is provided on one or both sides of the plane of the signal conductors. Within the body of the cable, often at the edge of the cable are provided one or more solid or stranded conductive drain wires which provide grounding of the shielding. Where the insulation of the cable is polytetrafluoroethylene (PTFE) or porous expanded PTFE, it has been found that the position of the drain wires with respect to the signal wires of the cable has often been difficult to control, since the drain wire does not always properly adhere to insulation such as polytetrafluoroethylene and comes loose within the insulation. This looseness results in uncertain positioning of the drain wire within the cable for group termination of the drain wires along with the signal conductors to an insulation displacement connector.

SUMMARY OF THE INVENTION

The present invention provides a flat multiconductor ribbon cable for transmission of data signals which is compatible with insulation displacement connectors and which includes firmly held and accurately spaced drain wires to provide grounding for the shielding of the cable. Heretofore, the bonding between the preferred PTFE insulation and the metal drain wires was not particularly reliable because of the difficulty of bonding metal to PTFE, which often resulted in loose drain wires which were not always accurately spaced in relation to the signal wires and could thus not reliably be terminated to IDC connectors. The present invention solves the problem of loose attachment and inaccurate spacing by spirally wrapping, prior to the cabling process, the drain wires with spaced yarns, preferably comprising porous expanded PTFE. Other such polymers also utilizable include fluorinated ethylene-propylene copolymers (FEP), copolymers of ethylene and tetrafluoroethhylene, polyvinyl chloride, fluorinated vinyl ethers (PFA), and the like. The polymer should be heat-resistant, bond well with the insulation, and have good wrapping strength. The yarn wrap spiralled about the drain wire covers from about 10% to about 70% of the exposed surface of the drain wire. About 25% surface coverage of a solid 26 AWG copper drain wire with a helical wrap of a 400 denier fiber of porous expanded PTFE was prepared. This wrapped drain wire was cabled with several 28 or 30 AWG solid copper signal wires which were individually insulated with porous expanded PTFE and either perforated copper foil or braided nickel-plated copper shielding layers to give a shielded ribbon cable which was raised to porous expanded PTFE melting temperatures under pressure during the cabling process. The heat and pressure caused firm and accurately-spaced attachment of the wrapped drain wire to the remainder of the cable, the shielding and the insulation which contact the wrapped drain wire. The spacing of and the composition of the fiber spiralled or helically-wrapped around the drain wire are both important. Enough heat- and pressure-bondable fiber wrap in a yarn or fiber of adequate size must be present surrounding the drain wire to provide enough bonding surface exposed to the PTFE to bond to and to hold the drain wire in place. Also, enough metal of the drain wire must be exposed to the shielding to provide good electrical contact with the shielding of the cable. The successful bonding of drain wires by this method thus solves two long-standing problems in the manufacture of ribbon cables.

DESCRIPTION OF THE PREFERRED EMBODIMENTS

Figure 1:
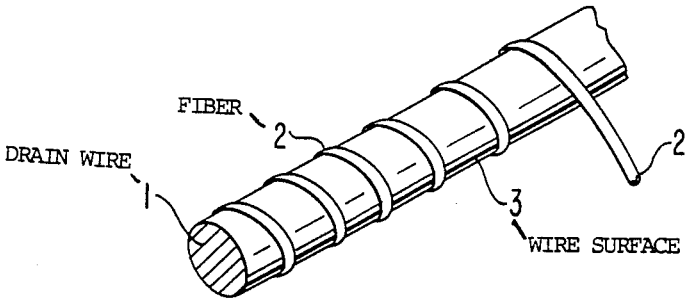
FIG. 1 shows, in perspective, a drain wire helically wrapped by a spaced polymer fiber.

Referring now to the figures to more closely describe and delineate the invention, FIG. 1 shows a perspective drawing of a drain wire 1 of the invention helically wrapped with a strand 2 of polymer yarn or fiber with exposed wire surface 3 left between the coils of strand 2 to allow contact between wire 1 and the shielding material of a flat ribbon cable. Drain wire 1 may be a nickel-plated copper or copper alloy wire or silver-plated copper wire or other suitably conductive materials. Fiber 2 is preferably made from porous expanded PTFE by methods disclosed in one or more of U.S. Pat. No. 3,953,566, 4,187,390, 4,096,227, 4,110,392, 4,025,679, 3,962,153, 4,382,516. Where drain wire 1 is about 26 AWG in size, a 400 dernier fiber 2 is about the correct size. Larger or smaller wires 1 usually require larger or smaller fibers 2 to provide adequate bonding of the fiber and thus the drain wire to the insulation of the ribbon cable. Coverage of the exposed wire surface 3 by fiber 2 may be about 10% to about 70% with about 25% as the optimum.

Figure 2:
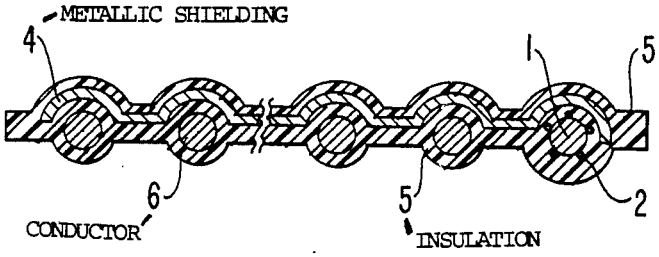
FIG. 2 describes a cross-section of a ribbon cable shielded on one side, including one drain wire.

FIG. 2 shows a cross-section of ribbon cable conductors 6 surrounded by insulation 5 and including metallic shielding 4 on one side of the flat cable and fiber-wrapped drain wire 1 on one side of the cable. Shielding 4 may be perforated copper foil, braided conductive wire shielding of copper, metal-plated copper or copper alloy, or solid copper foil, for instance. Insulation 5 may be porous EPTFE.

Figure 3:
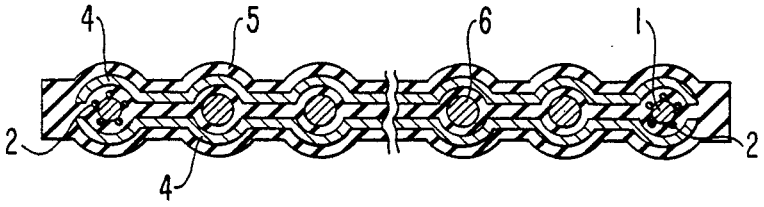
FIG. 3 depicts a ribbon cable in cross-section having a shield on both sides of the plane of the cable and a drain wire on each edge of the cable.

FIG. 3 describes a cross-section of a ribbon cable of similar construction to that of FIG. 2, but having shielding 4 on both sides of the cable and a braided polymer fiber 2 wrapped drain wire 1 on each edge of the cable.

Figure 4:
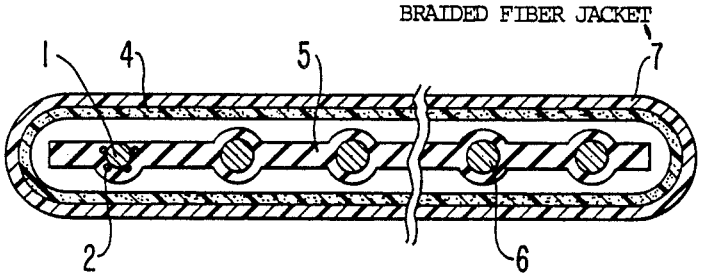
FIG. 4 discloses a cross-section of a cable having a 360° shield and a braided polymer fiber jacket wrapped around it.

FIG. 4 discloses a cross-section of a highly flexible embodiment of a ribbon cable including signal wires 6 spaced at regular pre-determined intervals in insulation 5, a polymer wrapped drain wire 1 adjacent the insulated conductors 6 at one end of the ribbon cable, a 360° shield 4 of braided metal-plated copper, such as nickel-plated copper, solid copper foil, copper mesh, copper wires or aluminized polyester, and a braided polymer fiber jacket 7. The jacket may be braided from porous expanded PTFE, FEP, PFA, polyvinylidine fluoride, polyvinyl chloride, polyurethane, or the like.

At some point in the manufacture of each of the flat ribbon cables described above, the cable is heated to a temperature at which insulation 5 and insulation fiber 2 wrapped around drain wire 1 become molten and the cable subsequently cooled to fix in place on a predetermined spacing and bond to the insulation all the wires 1 and 6 which comprise the cable of the invention. Fiber 2 wrapped drain wire 1 is securely fixed in place in the cable by the adherance provided by fiber 2 and has conductive contact with shielding material 4 so that shield 4 may be grounded properly in as IDC termination process of the cable.

It will be obvious to those skilled in the art to make various substitutions and changes in the materials and methods used in carrying out the invention, but the scope of the invention is delineated only by the appended claims.

What is claimed is:

1. A flat multi-conductor ribbon electrical cable comprising:

(a) a multiplicity of metal signal conductors separated and spaced apart at predetermined distances by webs of insulation which surround and insulate said conductors;

(b) metallic shielding adjacent and surrounding said webs and said conductors on at least one side;

(c) at least one conductive drain wire wrapped with coils of a polymer fiber, each said coil of said wrapped fiber being spaced apart at a predetermined distance from each other said coil of said fiber; and (d) a layer of insulation surrounding said conductors, said at least one drain wire, and said shielding.

2. A cable of claim 1 wherein said polymer fiber coils are spirally or helically wrapped around said at least one drain wire.

3. A cable of claim 2 wherein said polymer fiber coils are therone plastic.

4. A cable of claim 2 wherein said polymer fiber coils are selected from the group comprising expanded polytetrafluoroethylene, fluorinated ethylene-propylene copolymer, copolymer of ethylene and tetrafluorethylene, fluorinated vinyl ethers, and polyvinyl chloride.

5. A cable of claim 1 wherein said web of insulation surrounding said conductors and said at least one drain wire comprises porous expanded polytetrafluoroethylene.

6. A cable of claim 2 wherein said webs of insulation surrounding said conductors and said at least one drain wire comprises porous expanded polytetrafluoroethylene.

7. A cable of claim 6 wherein said insulation surrounding said conductors, said at least one drain wire, and said shielding comprises polymer fibers.

8. A cable of claim 7 wherein said braided polymer fibers are selected from porous expanded polytetrafluoroethylene, fluorinated ethylene-propylene copolymer, polyvinylidine fluoride, polyvinyl chloride, or polyurethane.

9. A cable of claim 1 wherein said metallic shielding is selected from solid copper foil, perforated copper foil, copper mesh, braided copper wires, braided metal-plated copper wires, or aluminized polyester.

* * * * *